US007155135B2

(12) United States Patent
Noguchi et al.

(10) Patent No.: US 7,155,135 B2
(45) Date of Patent: Dec. 26, 2006

(54) IMAGE FORMING APPARATUS WITH MODE HAVING PROLONGED ROTATION TIME OF IMAGE BEARING MEMBER AT NON-IMAGE FORMING TIME

(75) Inventors: Bunro Noguchi, Shizuoka (JP); Shinichi Tsukida, Saitama (JP); Jun Suzuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 457 days.

(21) Appl. No.: 10/669,334

(22) Filed: Sep. 25, 2003

(65) Prior Publication Data

US 2004/0061666 A1 Apr. 1, 2004

(30) Foreign Application Priority Data

Sep. 27, 2002 (JP) ..... 2002-282758

(51) Int. Cl.
*G03G 15/02* (2006.01)

(52) U.S. Cl. ..... 399/50; 399/100

(58) Field of Classification Search ..... 399/50, 399/99, 100, 101, 174, 343, 169
See application file for complete search history.

(56) References Cited

U.S. PATENT DOCUMENTS 5,305,177 A * 4/1994 Aoki et al. ..... 361/225
5,426,488 A * 6/1995 Hayakawa et al. ..... 399/174
5,822,646 A 10/1998 Kinoshita et al. ..... 399/24
5,845,172 A * 12/1998 Saito et al. ..... 399/50
6,047,145 A * 4/2000 Shigezaki et al. ..... 399/50
6,088,548 A * 7/2000 Hashimoto et al. ..... 399/50
6,408,145 B1 * 6/2002 Ohki ..... 399/50
2002/0159782 A1 * 10/2002 Tsuruya et al. ..... 399/50

FOREIGN PATENT DOCUMENTS

EP 0901047 A2 * 3/1999
JP 63208881 A * 8/1988
JP 9-179383 7/1997
JP 11149205 A * 6/1999
JP 11-219086 8/1999
JP 2000-29757 2/2000

* cited by examiner

*Primary Examiner*—Robert Beatty
(74) *Attorney, Agent, or Firm*—Fitzpatrick, Cella, Harper & Scinto

(57) ABSTRACT

The image forming apparatus includes a rotatable image bearing member, a charging member that is contactably provided to the image bearing member and that charges the image bearing member with a voltage containing an AC component and a DC component; and a control device that makes selection on whether a mode, in which a rotation time of the image bearing member is prolonged and in which a voltage is applied to the charging member in the prolonged rotation time, is performed or not. As a result, the image forming apparatus is provided which performs charging with high stability.

10 Claims, 6 Drawing Sheets

$$SF1 = \frac{(MXLIG)^2}{AREA} \times \frac{\pi}{4} \times 100$$

$$SF-2 = \frac{(PERI)^2}{AREA} \times \frac{1}{4\pi} \times 100$$

IMAGE FORMING APPARATUS WITH MODE HAVING PROLONGED ROTATION TIME OF IMAGE BEARING MEMBER AT NON-IMAGE FORMING TIME

BACKGROUND OF THE INVENTION

1. Field of the Invention

The present invention relates to an image forming apparatus, which includes a charging member that is provided contactably to an image bearing member and charges the image bearing member, such as a laser printer, a copying machine, or a facsimile.

2. Related Background Art

Conventionally, an image forming apparatus, which uses an electrophotographic process or the like, such as a printer, a copying machine, or a facsimile is provided with a charging apparatus that charges a surface of an image bearing member.

Examples of such charging apparatuses include a charging apparatus of corona discharging system and a charging apparatus of contact charging system which charges a surface of a photosensitive member through application of a voltage to a charging member in a state in which the charging member such as a charging roller is in direct contact with the photosensitive member.

Further, the above-mentioned contact charging apparatuses have a DC application system (what is called a DC charging system) in which a voltage to be applied includes only a direct-current component and an AC+DC application system (what is called a AC charging system) in which both an alternating component and a direct-current component are applied. The DC charging system and the AC charging system each include a constant current system and a constant voltage system.

Under the comparison between the DC charging system and the AC charging system in the contact charging apparatus, the DC charging system has a disadvantage that, when a resistance value of the charging member varies due to an environmental change on a temperature, moisture, or the like, a charging potential of a surface of the photosensitive member to be charged is prone to vary accordingly. Therefore, in the case of using the DC charging system, since it has been essential that the temperature or moisture in the environment where the charging apparatus is placed is always detected, and a voltage or current to be applied to the charging member is controlled based on the detected information, there has been a problem in that the DC charging system charging apparatus becomes complicated by being equipped with a temperature sensor or moisture sensor.

As the above-mentioned DC charging system charging apparatus, there is proposed one in which, based on the measurement of a temperature and moisture, a constant current control is conducted under a certain environmental condition while a constant voltage control is conducted under another environmental condition, thereby avoiding the formation of an abnormal image (refer to, for example, Japanese Patent Application Laid-Open No. H09-179383).

Further, in comparison to the AC charging system, the DC charging system presents a problem in that image failure due to charging failure is prone to develop even in the case where slight contamination of the charging member is generated by a lubricant between a cleaning member and an image bearing member or a waste developer that has passed through the cleaning member due to cleaning failure.

On the other hand, in comparison to the DC charging system, in the AC charging system, stable charging property can be obtained without large influence due to environmental fluctuation of the temperature, moisture, and the like.

However, it is known that, when AC charging is used, an abrasion amount of a thickness of a surface layer of the image bearing member is increased compared with the case of using DC charging. In order to suppress the increase of the abrasion amount to as low a level as possible, there is proposed an image forming apparatus in which control is performed such that AC charging is used at the time of image forming while the system is switched to DC charging at the time of non-image forming (refer to, for example, Japanese Patent Application Laid-Open No. 2000-39757).

On the other hand, as a conventional example with the purpose of improving cleaning property irrespective of a charging system, there is also proposed an image forming apparatus in which control is performed such that backward rotation is prolonged (refer to, for example, Japanese Patent Application Laid-Open No. H11-219086).

The AC charging system is more advantageous for obtaining stable charging property with the above-described simple structure. However, on the contrary, in the AC charging system, the surface of the image bearing member, which serves as a member to be cleaned, vibrates due to the applied AC component, chattering of the cleaning member develops, and thus, a transfer residual developer becomes difficult to be removed by cleaning means, which may lead to a case where cleaning property of the image bearing member is not sufficiently obtained. In particular, when a spherical developer is used, there may be a case where a collecting property of the cleaning member is not sufficiently obtained.

Further, the control method, which is described in the conventional example and in which switching is performed such that AC charging is used at the time of image forming while DC charging is used at the time of non-image forming, has an effect to the above-described problem in a sense that cleaning property is improved because the system is switched to DC charging in the intermittent one-sheet image output. However, the original object of the image forming apparatus is the prevention of abrasion of the surface layer of the image bearing member. Therefore, there still remains a problem in that, in the case where a non-image region does not exist between images in continuous printing, and thus, high-printing images are continuously output or in the case where a non-image region does not exist between images in continuous printing, and thus, high-printing images are continuously output in a multi-color or color image forming apparatus that uses an intermediate transferring member, a large amount of secondary transfer residual developer, which is inversely transferred from the intermediate transferring member to the image bearing member, cannot be fully cleaned by the cleaning member, which leads to the occurrence of image failure.

SUMMARY OF THE INVENTION

The present invention has been made in view of the above, and has an object to provide an image forming apparatus that performs charging with high stability through application of a voltage containing an AC component to a charging member.

Another object of the present invention is to provide an image forming apparatus that avoids cleaning failure or contamination of a charging member, which arises from vibration of a surface of an image bearing member due to an AC component applied to the charging member.

Another object of the present invention is to provide an image forming apparatus in which productivity of image forming is kept from being lowered as reliably as possible.

Still another object of the present invention is to provide an image forming apparatus in which it is made possible that a rotation time of an image bearing member is prolonged to remove a residual developer.

Still another object of the present invention is to provide an image forming apparatus in which selection can be made as to whether a time for promoting cleaning is provided or not.

Still other objects and features of the present invention will be apparent by referring to the accompanying drawings and reading the following detailed description.

DESCRIPTION OF THE PREFERRED EMBODIMENTS

<Embodiment 1>

(1) Example of Image Forming Apparatus

Figure 1:
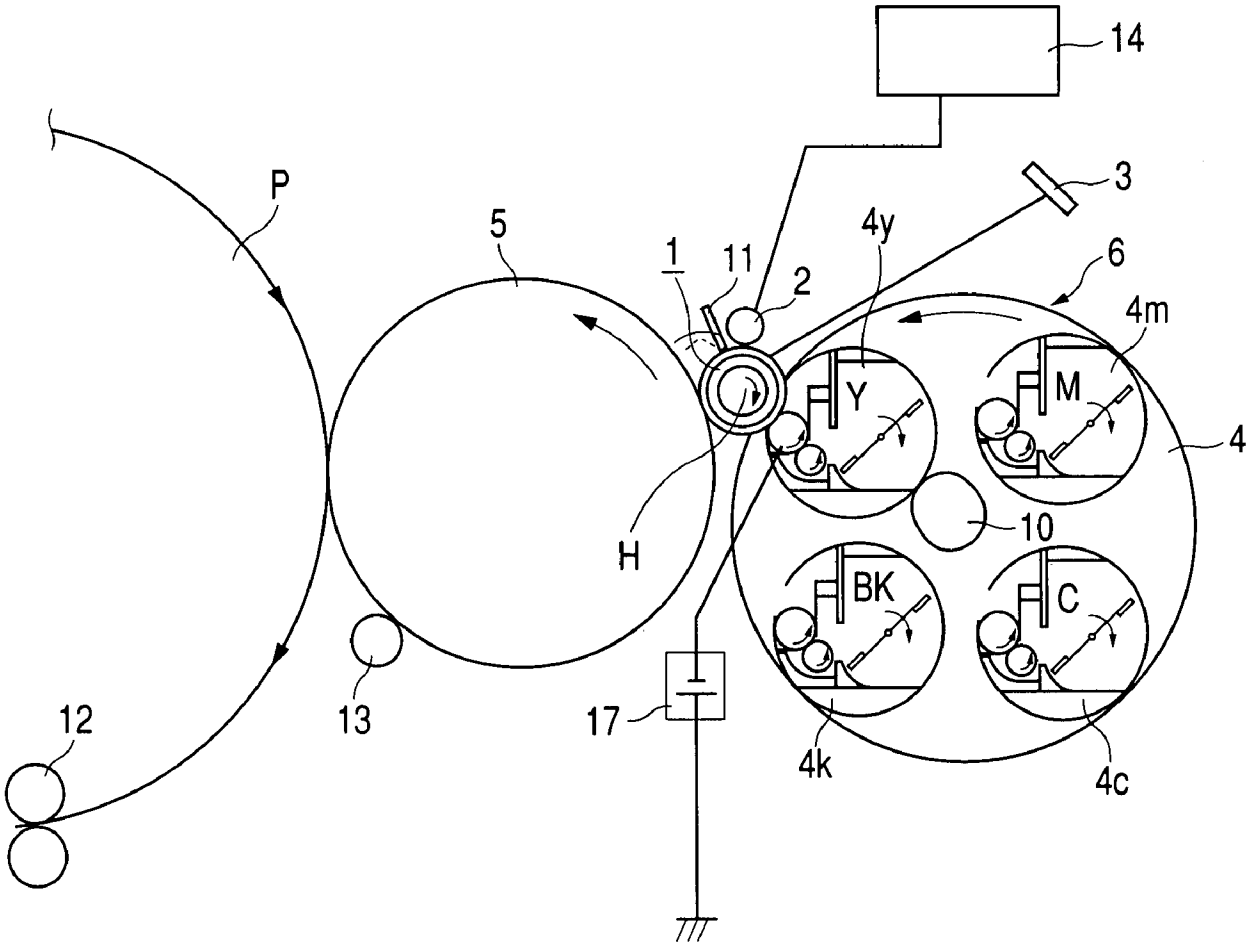
FIG. 1 is a schematic diagram of a multi-color image forming apparatus in accordance with Embodiment 1 of the present invention.

FIG. 1 is a schematic diagram of a multi-color image forming apparatus, such as a color laser printer, which corresponds to Embodiment 1 of the present invention.

The multi-color image forming apparatus of this embodiment is characterized by including control means for performing switching to the mode in which the rotation time of an image bearing member is prolonged at the time of non-image forming, and an applied bias to a charging member is switched from a bias in which an AC component and a DC component are superimposed with each other to a bias only containing a DC component, that is, the mode in which cleaning of the image bearing member, which is different from a normal image forming operation, is promoted.

The multi-color image forming apparatus of this embodiment which is shown in FIG. 1 is mainly constituted by a photosensitive drum 1 serving as an image bearing member, a charging roller 2 that is a contact charging member 2 as a charger (charging device) which serves as charging means for uniformly charging the photosensitive drum 1, an exposure device 3 that exposes the photosensitive drum 1 based on image information, a rotary developing apparatus 4 that supports plural developing devices 4*y*, 4*m*, 4*c*, and 4*k*, and an intermediate transferring body 5.

Figure 2:
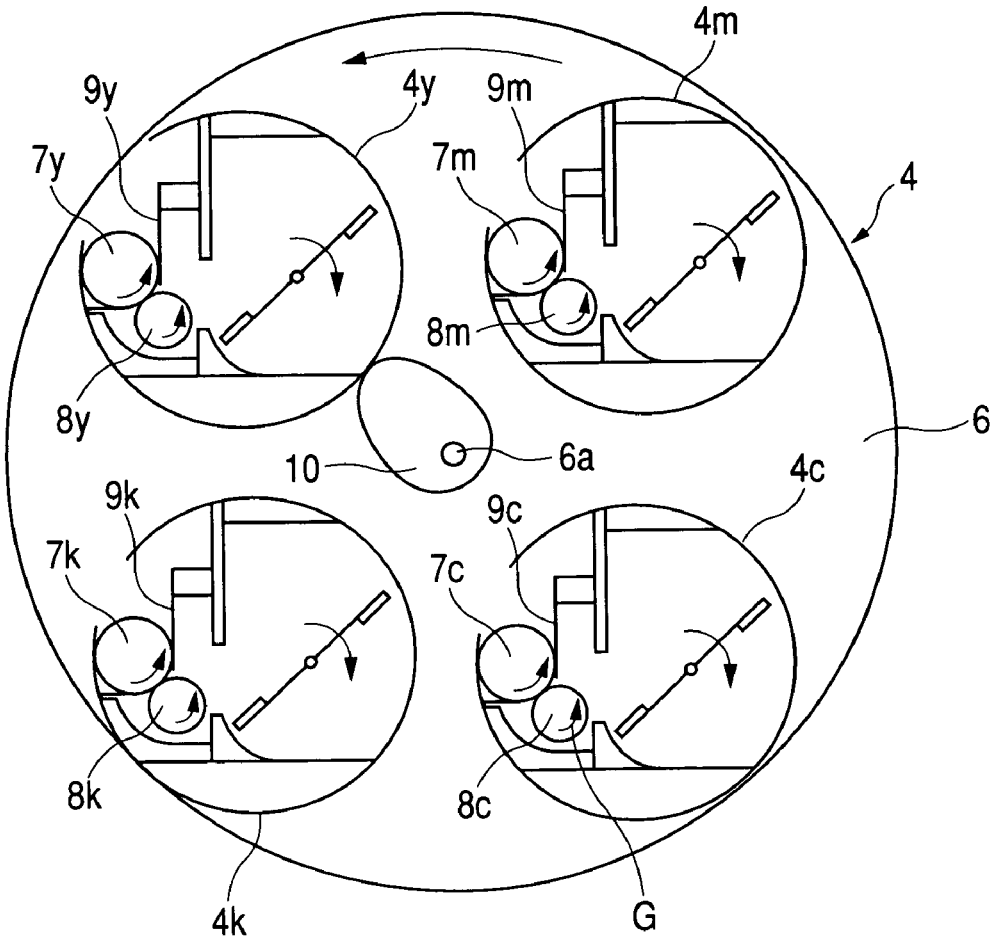
FIG. 2 is an enlarged diagram of a rotary developing apparatus provided to the multi-color image forming apparatus in accordance with Embodiment 1.

FIG. 2 is an enlarged diagram of the rotary developing apparatus 4. The rotary developing apparatus 4 positions one of the four developing devices 4*y*, 4*m*, 4*c*, and 4*k* at a developing position through rotation of a supporting member 6. The rotary developing apparatus 4 has developing opening surfaces of the respective developing devices 4*y*, 4*m*, 4*c*, and 4*k* on a circumference of the same circle with a supporting member rotation axis 6*a* as its center.

The developing devices 4*y*, 4*m*, 4*c*, and 4*k* respectively have developing rollers 7*y*, 7*m*, 7*c*, and 7*k* each of which is a developer carrying member in order to convey a developer to a contact portion with the photosensitive drum 1. Further, arranged around the developing rollers 7*y*, 7*m*, 7*c*, and 7*k* are supply rollers 8*y*, 8*m*, 8*c*, and 8*k*, respectively, which rotate in a direction of an arrow G in FIG. 2 to supply and apply a non-magnetic mono-component developer onto the developing rollers 7*y*, 7*m*, 7*c*, and 7*k*, and developing blades 9*y*, 9*m*, 9*c*, and 9*k* which impart a desired charging amount to the developer on the developing rollers 7*y*, 7*m*, 7*c*, and 7*k*, respectively, to regulate a developer amount. Besides, there is provided a developing bias voltage power source 17 that applies developing bias voltages to the respective developing rollers 7*y*, 7*m*, 7*c*, and 7*k*.

Further, the rotary developing apparatus 4 is structured such that each of the developing devices 4*y*, 4*m*, 4*c*, and 4*k* is pressurized by a pressurizing apparatus 10 only at the time of developing to thereby abut each of the developing rollers 7*y*, 7*m*, 7*c*, and 7*k* in each of the developing devices 4*y*, 4*m*, 4*c*, and 4*k*, respectively, against the photosensitive drum 1; and each of the developing rollers 7*y*, 7*m*, 7*c*, and 7*k* in each of the developing devices 4*y*, 4*m*, 4*c*, and 4*k*, respectively, is separated from the photosensitive drum 1 while the rotary developing apparatus 4 is being rotated or when a pressurizing operation of the pressurizing apparatus 10 is released at the time of non-developing.

As shown in FIG. 1, the photosensitive drum 1 is rotated in a direction of an arrow H in FIG. 1, and is uniformly charged by the charging roller 2, and thereafter, an electrostatic latent image is formed on the photosensitive drum 1 by means of the exposure device 3. The latent image is a latent image corresponding to a color developer in each of the developing devices 4*y*, 4*m*, 4*c*, and 4*k*, each of which is yellow (Y), magenta (M), cyan (C), and black (Bk), respectively.

This will be described in detail. First, the electrostatic latent image corresponding to the developer of the first color, yellow, is formed on the photosensitive drum 1, the latent image is visualized by the developing device 4*y* containing the yellow developer, and then, the developer image is transferred onto the intermediate transferring body 5. Subsequently, the residual developer on the photosensitive drum 1 is cleaned by a cleaning blade 11. Then, the electrostatic latent image corresponding to the developer of the second color, magenta, is formed on the photosensitive drum 1, the latent image is visualized by the developing device 4*m* containing the magenta developer, and then, the magenta visualized image is superimposed and transferred onto the intermediate transferring body 5 on which the first-color, yellow, visualized image has already been transferred.

The above-described operation is performed ditto also for cyan and black, and thus, the developers, which have been superimposed on one another in four layers on the intermediate transferring body 5, are collectively transferred onto a transferring material P which is a member to be transferred. Successively, the image of the developers of four colors is melted by a fixing apparatus 12 to be fixed onto the transferring material P, and is exhausted to the outside of the image forming apparatus. Further, the developer, which has not been transferred onto the transferring material P and remains on the intermediate transferring body 5, is charged with an opposite polarity to a normal charging polarity of the developer by means of a charge imparting roller 13 that serves as contact charging means, and thus, is inversely transferred onto the photosensitive drum 1, returned to the photosensitive drum 1, and cleaned by the cleaning blade 11. A charging position with the charge imparting roller 13 is preferably on the downstream side of a secondary transfer position and the upstream side of a primary transfer position in a moving direction of the intermediate transferring body in order that the developer remaining on the intermediate transferring body is quickly charged by the charge imparting roller 13 after a secondary transfer.

That is, after the secondary transfer in a secondary transfeffing portion, the developer remaining on the intermediate transfeffing body 5 is applied with a bias having an opposite polarity to that in an image forming region on the intermediate transfeffing body 5 (also, opposite polarity to a charging polarity of the photosensitive drum 1) by means of the charge imparting roller 13 which is structured so as to be abutted with/separated from the intermediate transferring body 5 at predetermined timing, and then, is discharged from the intermediate transferring body 5 to the photosensitive drum 1. The developer, which has been discharged onto the photosensitive drum 1, is removed by the cleaning blade 11 before the formation of the next image is started.

Note that the developer used here is a spherical developer with a shape factor SF1 of 100 to 160 and a shape factor SF2 of 100 to 140.

(2) Cleaning Promoting Sequence

The image forming apparatus of this embodiment is characterized in that cleaning promoting duration (cleaning promoting mode), which will be described next, is provided at the time of non-image forming.

Figure 3A:
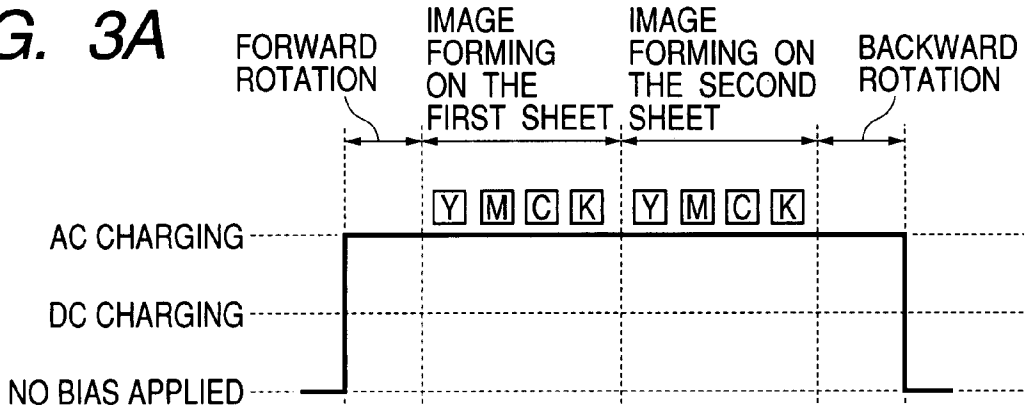
FIG. 3A is a timing chart showing transition of a charging method in normal image forming at the time of continuous printing of two sheets in Embodiment 1.
Figure 3B:
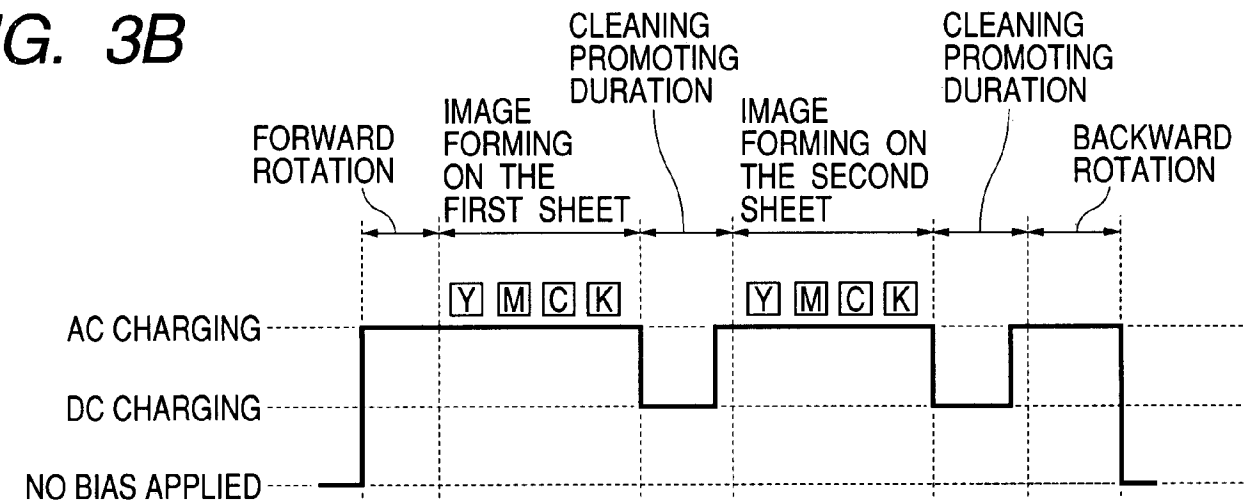
FIG. 3B is a timing chart showing transition of a charging method in a cleaning promoting sequence at the time of continuous printing of two sheets in Embodiment 1.

FIG. 3A shows timing of transition of a charging system in normal image forming at the time of two-sheet continuous printing. FIG. 3B shows timing of transition of a charging system in a cleaning promoting sequence at the time of two-sheet continuous printing.

Here, "forward rotation" in FIGS. 3A and 3B indicates a duration in which, when an image forming (print job) starting signal is input to the image forming apparatus in a standby (waiting) state, a main motor is driven in accordance with the input signal to perform an operation preceding image forming of a required processing apparatus. More practically, the duration involves the sequence of: (1) reception of the image-forming starting signal by the image forming apparatus; (2) development of an image with a formatter (a development time varies depending on an image data amount or processing speed of the formatter); and (3) start of a forward rotation step.

Further, "backward rotation" indicates a duration in which the main motor is continuously driven to perform the operation after image forming of the required processing apparatus even after a recording material, on which an image has been formed, is output (completion of image forming) in the case of the image forming with only one sheet or after a recording material, on which the last image in continuous image forming has been formed, is output (completion of image forming) in the case of the continuous image forming. After the completion of a predetermined backward rotation step, the drive of the main motor is stopped, and the image forming apparatus is kept in the standby (waiting) state until the next image-forming starting signal is input.

As to the charging system transition at the time of normal image forming, as shown in FIG. 3A, AC charging (a first voltage containing an AC component and a DC component is applied to the charging roller 2) starts at the start of the forward rotation, the AC charging is continued without being stopped in the image forming operation with two sheets, and bias application to the charger is turned into an OFF state at the time of the completion of the backward rotation.

On the other hand, as to the charging system transition in the cleaning promoting sequence, as shown in FIG. 3B, it is similar to the above-described charging system transition in that the AC charging starts at the time of the start of the forward rotation; however, the cleaning promoting duration exists between the completion of image forming on the first sheet and the start of image forming on the second sheet, and the charging system is switched to a DC charging system (a second voltage containing a DC component and not containing an AC component is applied to the charging roller 2 as a charging roller). Before the start of image forming on the second sheet, the charging system is switched back to the AC charging earlier by a time necessary for one cycle of the photosensitive drum 1, in order to avoid an influence on image forming on the second sheet. The cleaning promoting duration is provided also after image forming on the second sheet, and the charging system is switched to the DC charging in a similar manner. Lastly, before the start of the backward rotation operation, the system is returned to the AC charging earlier by a time necessary for one cycle of the photosensitive drum 1, the backward rotation operation is performed, and then, two-sheet continuous printing is finished. Here, the reason that the system is returned from the DC charging to the AC charging a little early is because satisfactory charging property is obtained to have no influence on the image forming or backward rotation operation.

As described above, in the cleaning promoting sequence, the AC charging system is used when the charger 2 as a charging member contacts a region to become an image forming region of the photosensitive drum 1 while the DC charging system is used at least in a part of a region to become a non-image forming region in the charger 2 as a charging member. As shown in FIG. 3B, the DC charging system is preferably adopted in the region between the regions to be the image forming regions or in the region subsequent to the region to become the image forming region.

Further, it is preferable that the cleaning promoting duration is made longer than the duration described next. That is, the duration in which the developer, which has not been transferred onto the transferring material P and remains on the intermediate transferring body 5, is charged by the charge imparting roller 13 to be returned to the photosensitive drum 1, and is cleaned by the cleaning blade 11. The cleaning promotion duration has to be equal to or longer than that duration. That is, it is preferable that the prolonged rotation time of the photosensitive drum 1 in the cleaning promoting duration corresponds to equal to or larger than the sum of the period during which the intermediate transferring body 5 moves from the secondary transfer position to the primary transfer position and the period during which the photosensitive drum 1 moves from the primary transfer position to the cleaning position of the cleaning blade 11. Further, the charging system at this time is preferably the DC charging in order to prevent vibration of the photosensitive drum 1 to enhance cleaning property. As described above, when the charging system is the AC charging system, vibration of the photosensitive drum 1 occurs due to AC application to the charger 2 as a charging member, as a result of which cleaning with the cleaning blade 11 is difficult to be satisfactorily performed.

Further, it is made possible that a user can make an arbitrary selection on whether or not the normal image forming operation is performed (FIG. 3A) or the cleaning promoting sequence is performed (FIG. 3B). That is, there are provided control means (a control circuit) 14 at a control part, which prolongs the image bearing member rotation time at the time of non-image forming aside from the normal image forming operation and switches the applied bias to the charging means to only the DC component, and control mode selection means, which prolongs the image bearing member rotation time at the time of non-image forming by means of the control means 14 and with which the user can make arbitrary selection on whether or not the cleaning promoting sequence is performed or the normal image forming operation is performed. The control mode selection means can be provided in an appropriate form of a touch panel type, switch type, or the like with respect to an operation panel (not shown in the figure) in the image forming apparatus.

Endurance tests were performed with the image forming apparatus of this embodiment under the same conditions except the "normal image forming sequence" (FIG. 3A) and the "cleaning promoting sequence" (FIG. 3B), thereby studying the occurrence of image failure due to cleaning failure. It is assumed that the life of each of the photosensitive drum and the cleaning blade used in the image forming apparatus corresponds to 5,000 sheets.

The study results are shown in Table 1. In Table 1, o denotes pass, while x denotes fail. According to the study, lengthwise streaks were generated due to the cleaning failure from the time when 4,000 sheets have been passed in the normal image forming sequence, but the cleaning failure did not occur in the cleaning promoting sequence. It is apparent from the study that, even in the situation in which the cleaning failure is apt to occur due to deterioration of an edge of the cleaning blade or deterioration of slipping property of the photosensitive drum surface in the latter half of the life, the cleaning promoting sequence can avoid the cleaning failure.

TABLE 1

| | Each Sequence and Image Failure | | | |
|---|---|---|---|---|
| | Image failure (Lengthwise Streak) | | | |
| Sequence | Initial | At 3,000 sheets | At 4,000 sheets | At 5,000 sheets |
| Normal image forming | o | o | x | x |
| Cleaning promoting | o | o | o | o |

With the use of the above-described means, sufficient cleaning of the image bearing member is performed by providing the cleaning promoting duration in which the rotation time of the image bearing member at the time of back rotation is prolonged. Further, cleaning property of the image bearing member is improved by switching the charging system of the cleaning promoting duration to the DC charging, as described above. Therefore, the cleaning promoting duration can be shortened as much as possible compared with the case where the cleaning promoting duration is provided while the AC charging system is continued. As a result, even in the case where a large amount of transfer residual developer is generated after high-printing image output or the like, the occurrence of the image failure due to the cleaning failure can be suppressed. Further, since the AC charging is used in image forming, satisfactory charging property, which is hard to be affected by environmental variation on a temperature, moisture, or the like. Thus, the image failure of streaks or the like due to contamination of the charging member is difficult to occur. Moreover, the manufacturing cost of the image forming apparatus main body can be kept low because the above-described means does not require a special member.

Further, when it is made possible that a user can make selection on whether the cleaning promoting sequence is performed or not, the cleaning promoting duration is provided only when the user suffers drawbacks and thinks that improvement is needed because of the occurrence of contamination such as streaks in an output image due to the cleaning failure of the image bearing member. Therefore, the cleaning promoting duration does not unnecessarily begin, the lowering of a printing output speed due to the beginning of the cleaning promoting duration is avoided as much as possible, and the cleaning of the image bearing member can be conducted with efficiency. Moreover, the manufacturing cost of the image forming apparatus main body can be kept low because the above-described means does not require a special member.

<Embodiment 2>

Figure 4:
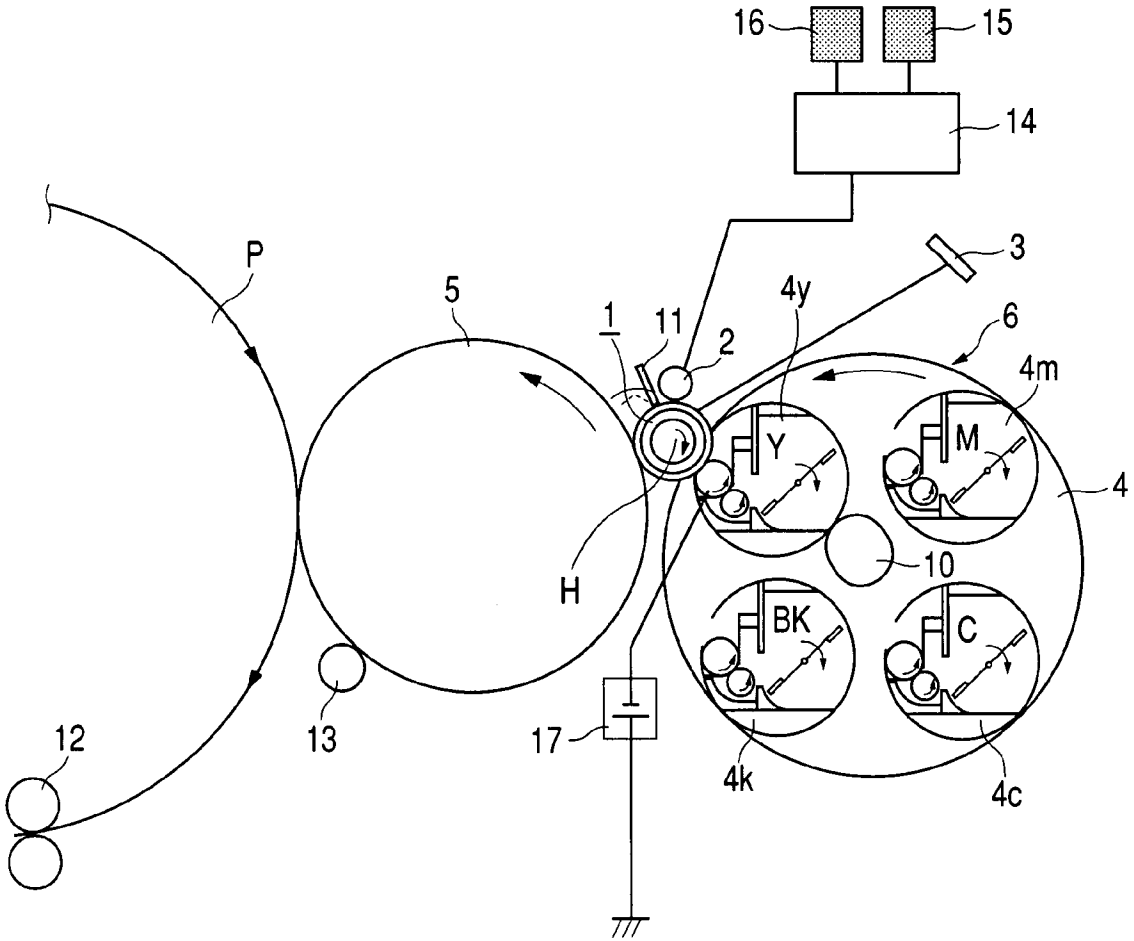
FIG. 4 is a schematic diagram of a multi-color image forming apparatus in accordance with Embodiment 2 of the present invention.

FIG. 4 is a schematic diagram of a multi-color image forming apparatus, such as a laser printer, which corresponds to Embodiment 2 of the present invention.

The multi-color image forming apparatus in FIG. 4 is obtained by adding the control means 14, print rate detecting means 15, and environment detecting means 16 to the image forming apparatus in FIG. 1 which has been used for the explanation of the image forming apparatus in Embodiment 1.

While the user makes arbitrary selection on whether the cleaning promoting sequence is performed or not in Embodiment 1, this embodiment is characterized in that: the control means 14 makes judgment on whether the cleaning promoting sequence is required or not based on the detection results of the print rate detecting means 15 and the environment detecting means 16; and the control is automatically conducted. Here, the cleaning promoting sequence has the same contents as those in FIGS. 3A and 3B used for the explanation in Embodiment 1.

Figure 5:
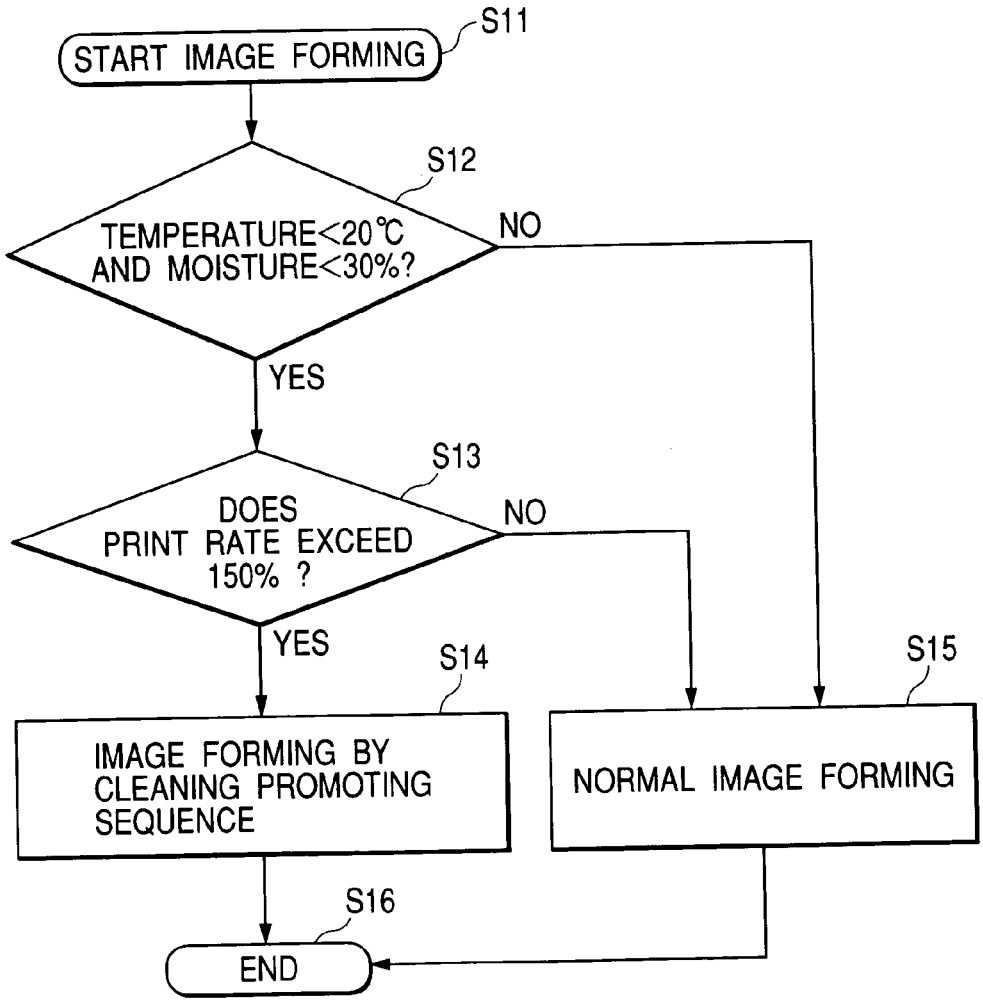
FIG. 5 is a flow chart showing a procedure of performing judgment on whether a cleaning promoting sequence is performed or not in accordance with Embodiment 2 of the present invention.

The judgment on whether the cleaning promoting sequence is performed or not in the image forming apparatus of this embodiment is made based on the procedure shown in a flow chart of FIG. 5.

When image forming is started (S11), first, a temperature and moisture are detected by the environment detecting means 16 (S12). In the case where the detected contents are judged at the control means 14 that a temperature <20° C. and moisture <30% are satisfied, the step proceeds to the judgment on the detection result of the print rate detecting means 15 (S13), while in the other cases, normal image forming is performed (S15), and the procedure is completed (S16). In the case where the control means 14 judges that the detection result of the total print rate of yellow, magenta, cyan, and black has a predetermined reference value or more, and is at 150% or more of the value in this embodiment, image forming is performed by the cleaning promoting sequence (S14), and the procedure is completed (S16). In the case where the control means 14 judges that the detection result is less than 150% of the value, normal image forming is performed (S15), and the procedure is completed (S16).

With the image forming apparatus of this embodiment, two conditions on the environment (temperature of 15° C., moisture of 20% and temperature of 25° C., moisture of 50%) and two conditions on the print rate (200% and 100%) are crossed, and a study is made as to image failure occurs due to cleaning failure in each of the "normal image forming sequence" and the "cleaning promoting sequence". Note that the life of each of the photosensitive drum and the cleaning blade, which are used in the image forming apparatus, corresponds to printing of 5,000 sheets, and evaluation is made at the time when 3,000 sheets have been printed. In addition, evaluation is made based on two-sheet continuous printing.

The study results are shown in Table 2. In table 2, o denotes pass, while x denotes fail. In the study, streaks develop due to the cleaning failure only at a temperature of 15° C., moisture of 20% and a print rate of 200% and in the normal image forming sequence. It is understood from the study that the image failure due to the cleaning failure can be avoided in the cleaning promoting sequence even at a low temperature and low moisture and at the time of high-printing image output where the image failure due to the cleaning failure occurs in the normal image forming sequence.

TABLE 2

| Environment/Print Rate and Image Failure | | |
|---|---|---|
| | Print rate 200% | Print rate 100% |
| Temperature 15° C., moisture 20% | x/o(*) | o/o(*) |
| Temperature 25° C., moisture 50% | o/o(*) | o/o(*) |

(*)Existence of occurrence of image failure (normal image forming sequence/cleaning promoting sequence)

With the use of the above-mentioned means, the cleaning promoting sequence is performed only in a low-temperature environment where following property of the cleaning blade with urethane rubber lowers with respect to vibration of the drum and the cleaning failure of the image bearing member is apt to occur, in a low-moisture environment where a charge amount of the developer increases the waste developer becomes difficult to be peeled off from the image bearing member due to an electric force and the cleaning failure of the image bearing member is apt to occur, and at the time of detection of high-printing image forming in which a large amount of transfer residual developer is generated due to the print rate detecting means; and the cleaning failure of the image bearing member is apt to occur. Therefore, the cleaning promoting duration is not entered unnecessarily, and the lowering of the print output speed due to the beginning of the cleaning promoting duration is avoided as much as possible. As a result, cleaning of the image bearing member can be performed with efficiency.

<Others>

1) The image forming apparatus in each of the embodiments is the multi-color or color image forming apparatus in which the intermediate transferring member 5 is used. However, the present invention is also effectively applied to a monochromatic image forming apparatus in which an image is transferred directly from the image bearing member 1 to the member to be transferred (transferring material P).

2) The exposure means 3 as information writing means is not limited to the laser beam scanner in each of the embodiments, and may be another digital exposure apparatus such as one obtained by combining a light source such as an LED array or a fluorescent tube with a liquid crystal shutter, or an analog exposure apparatus in which an original image is formed to be projected.

3) The image bearing member 1 may be an electrostatic recording derivative. In this case, a surface of the derivative is charged uniformly at a predetermined polarity/potential, and then, is subjected to selective static elimination by static eliminating means (information writing means) such as a static eliminating needle array or an electron gun.

4) The image bearing member 1 is not limited to a drum type one, and may be a rotating belt (endless belt), one obtained by attaching and fixing a sheet having ends to a supporting member in the form of a rotating belt, or the like.

5) The toner developing system/means of the electrostatic latent image is arbitrarily selected. Either a reversal developing system or a normal developing system may be adopted.

6) The intermediate transferring member is not limited to a drum type one, and may be in the form of a rotating belt or the like.

7) As to the waveform of the AC component (alternating voltage) of the bias applied to the charger 2 as a charging member or the rotary developing apparatus 4, a sine wave, rectangular wave, triangular wave, or the like may be appropriately used. The alternating bias includes, for example, a voltage with the rectangular wave formed by periodically turning on/off a direct-current power source.

8) Charging of the image bearing member may be conducted through the so-called injecting charging. In the case of the charge injecting charging, the image bearing member desirably has a layer with a surface resistance of $10^9$ Ω·cm to $10^{14}$ Ω·cm. For instance, there can be used an image bearing member that includes, as its basic constituents, a charge generating layer formed on a substrate surface and a charge transporting layer formed on a surface of the charge generating layer. Specifically, there can be used, as the image bearing member, one having charge injecting charging property, such as an OCL photosensitive member, in which a surface layer (charge injecting layer) in which conductive particles of $SnO_2$ or the like are dispersed is coated on an OPC photosensitive member, or a photosensitive member having a surface layer of α-Si (amorphous silicon, noncrystalline silicon).

9) The spherical toner is substantially a toner having a spherical shape. The toner is apt to roll from the viewpoint of the shape, has high frictional charging property, and has high developing property, transfer efficiency, and the like. In the present invention, SF-1 and SF-2 are used as the shape factors indicating toner sphericity.

SF-1 indicates a degree of toner roundness, and has a value of 100 at the level of a complete spherical shape. A toner shape gradually changes from a spherical shape to an indeterminate shape as the value becomes larger.

SF-2 indicates a degree of toner unevenness, and has a value of 100 at the level of a complete spherical shape. Unevenness on a toner surface becomes more conspicuous as the value becomes larger.

The values of SF-1 and SF-2 which are appropriate for the present invention are:

SF-1 value=100 to 160; and

SF-2 value=100 to 140, more preferably,

SF-1 value=100 to 140

SF-2 value=100 to 120.

Figure 6:
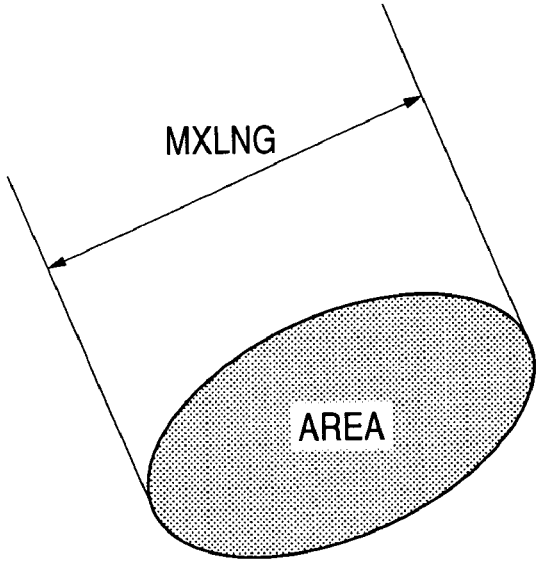
FIG. 6 is an explanatory diagram of a toner shape factor SF-1.
Figure 7:
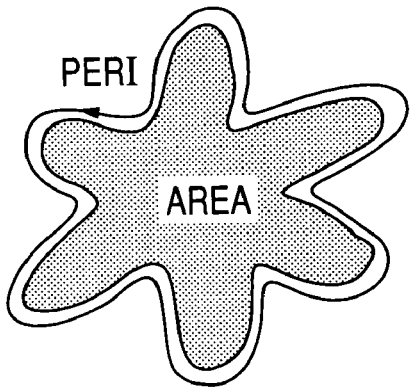
FIG. 7 is an explanatory diagram of a toner shape factor SF-2.

The values of SF-1 and SF-2 are obtained as follows: 100 pieces of toner images, which are enlarged with a magnification of 500× with the use of FE-SEM (S-800) manufactured by Hitachi, Ltd. are sampled at random; the information on the images is introduced to an image analyzing apparatus (LUZEX3) manufactured by Nicolet, Inc. through an interface to be analyzed; and then, the values are calculated based on the following expressions (refer to FIG. 6 and FIG. 7).

$$SF\text{-}1\ \text{value}=\{(MXLNG)^2/\text{AREA}\}\times(\Pi/4)\times100$$

$$SF\text{-}2\ \text{value}=\{(PERI)^2/\text{AREA}\}\times(1/4\Pi)\times100$$

AREA: toner projected area

MXLNG: absolute maximum length

PERI: peripheral length

Further, it is preferable that a coefficient of variation (A) in a number distribution is 35% or less in order to perform uniform charge stabilization to a toner and obtain higher transfer efficiency. The coefficient of variation (A) is expressed by the following expression.

Coefficient of variation (A)=(S/D1)×100

S: standard deviation in a toner number distribution

D1: number average particle diameter of a toner particle (MM)

Further, in order to faithfully develop a minute dot with the objective of achieving higher image quality, the toner particle diameter is preferably 10 MM or less, more preferably 4 to 8 MM in weight average particle diameter. For the measurement of the number distribution, Coulter Counter TA type II (made by Coulter, Inc.) was used.

Moreover, the manufacturing method for the above-mentioned spherical toner has variations. For example, ones, in which polymerization reaction is used, such as emulsion polymerization, suspension polymerization, and dispersion polymerization, are often utilized. Furthermore, besides the polymerization methods, there is a method in which a ground toner is dissolved with a solvent to have a spherical shape. The method of obtaining the spherical toner is not particularly limited.

In this embodiment, there is used the suspension polymerization in which a raw material containing a monomer, wax, charge controlling agent, initiator, and the like is suspended in a dispersion medium (usually, water) containing a dispersant to generate a toner through polymerization reaction.

The above-described spherical toner has high flow property, and has a charge amount apt to be uniform. Thus, the developing property and transferring property are enhanced; on the other hand, the waste developer also has high flow property, and thus, is apt to pass through the cleaning member, which leads to the lowering of cleaning property. In such a situation in which cleaning failure is apt to occur, when the control means is provided: with which the rotation time of the image bearing member is prolonged at the time of non-image forming differently from the normal image forming operation; and further, the applied bias to the charging means is switched from the bias in which an AC component and a DC component are superimposed on each other to the bias only containing a DC component, cleaning of the image bearing member can be performed sufficiently. Therefore, even in the case where a large amount of the transfer residual developer is generated after the high-printing image output or the like, the occurrence of the image failure due to the cleaning failure can be suppressed. Further, since the AC charging is used in the image forming, there can be obtained satisfactory charging property, which is difficult to be influenced by environmental variation on the temperature, moisture, and the like. As a result, the image failure such as the streaks due to contamination of the charging member is also difficult to occur.

As described above, according to the present invention, the image forming apparatus can be provided which has a simple structure, which includes the AC charging system with which charging can be performed with high stability, and in which the image failure due to the cleaning failure or contamination of the charging member does not occur.

What is claimed is:

1. An image forming apparatus comprising:

an image bearing member that is rotatable;

a charging member that is contactably provided to the image bearing member and charges the image bearing member, the charging member being capable of being applied with a first voltage which contains both an AC component and a DC component and a second voltage which does not contain an AC component and which contains a DC component, the first voltage being capable of being applied to the charging member at the time when the charging member charges a region to be an image forming region of the image bearing member;

image forming means for forming an image of a developer on the image bearing member;

cleaning means contactably provided to the image bearing member for cleaning the developer that remains on the image bearing member; and control means which allows a selection of either a first mode or a second mode, wherein in the second mode, a rotation time of the image bearing member at non-image forming time is prolonged to be longer than that in the first mode and the second voltage is applied to the charging member in the prolonged rotation time.

2. An image forming apparatus according to claim 1, wherein the region to be a non-image forming region is formed after the formation of the region to be an image forming region.

3. An image forming apparatus according to claim 1, wherein the region to be a non-image forming region is formed between the regions each of which becomes an image forming region.

4. An image forming apparatus according to claim 1, wherein selection is made as to whether the mode is performed or not in accordance with a print rate formed on the image bearing member.

5. An image forming apparatus according to claim 4, wherein performing the mode is selected when the print rate has a predetermined value or more.

6. An image forming apparatus according to claim 1, further comprising detecting means for detecting an environmental condition, wherein selection is made as to whether the second mode is performed or not based on detection results of the detecting means.

7. An image forming apparatus according to claim 1, wherein selection can be made by a user as said image forming apparatus allows a user to determines whether the second mode is performed or not.

8. An image forming apparatus according to claim 1, wherein:

a shape factor SF-1 of the developer is 100 to 160; and a shape factor SF-2 of the developer is 100 to 140.

9. An image forming apparatus according to claim 1, further comprising:

a first transfer means for transferring the image of the developer formed on the image bearing member onto an intermediate transferring body;

a second transfer means for transferring the image of the developer on the intermediate transferring body onto a member to be transferred; and developer charging means for, in order to transfer a residual developer that remains on the intermediate transferring body, charging the residual developer with an opposite polarity to a normal polarity of the developer.

10. An image forming apparatus according to claim 9, wherein:

a charging position of the developer charging means is provided on both an upstream side of a first transfer position of the first transfer means and a downstream side of a second transfer position of the second transfer means in a moving direction of the intermediate transferring body; and the prolonged rotation time in the second mode corresponds to equal to or larger than a sum of a time during which the intermediate transferring body moves from the second transfer position to the first transfer position and a time during which the image bearing member moves from the first transfer position to a cleaning position of the cleaning means.

* * * * *

UNITED STATES PATENT AND TRADEMARK OFFICE

CERTIFICATE OF CORRECTION

PATENT NO. : 7,155,135 B2
APPLICATION NO. : 10/669334
DATED : December 26, 2006
INVENTOR(S) : Bunro Noguchi et al.

It is certified that error appears in the above-identified patent and that said Letters Patent is hereby corrected as shown below:

ON THE TITLE PAGE:
At Item (56), References Cited, Foreign Patent Documents, "JP 63208881 A * 8/1988" should read --JP 63-208881 A * 8/1988--, "JP 11149205 A * 6/1999" should read --11-149205 A * 6/1999--.

COLUMN 1:
Line 31, "a AC" should read --an AC--.

COLUMN 5:
Line 22, "transfeffing" should read --transferring--.
Line 24, "transfeffing" should read --transferring--.

COLUMN 7:
Line 19, "arbitrary" should read --an arbitrary--.

COLUMN 8:
Line 17, "selection" should read --a selection--.
Line 42, "arbitrary" should read --an arbitrary--.

COLUMN 9:
Line 11, "to image" should read --to how image--.

COLUMN 12:
Line 60, "determines" should read --determine--.

Signed and Sealed this

Sixth Day of May, 2008

JON W. DUDAS
*Director of the United States Patent and Trademark Office*